US005306410A

United States Patent [19]

Farmer

[11] Patent Number: 5,306,410

[45] Date of Patent: Apr. 26, 1994

[54] METHOD AND DEVICE FOR ELECTRICALLY COUPLING A CONDUCTOR TO THE METAL SURFACE OF AN ELECTROLYTIC CELL WALL

[76] Inventor: Thomas E. Farmer, 1602 Biovu, Galveston, Tex. 77551

[21] Appl. No.: 985,291

[22] Filed: Dec. 4, 1992

[51] Int. Cl.[5] ..... C25B 9/04

[52] U.S. Cl. ..... 204/242; 204/279; 439/179

[58] Field of Search ..... 204/242, 279; 439/179

[56] References Cited

U.S. PATENT DOCUMENTS

| | | | |
|---|---|---|---|
| 3,591,483 | 7/1971 | Loftfield et al. | 204/252 |
| 3,622,944 | 11/1971 | Tsuchiya et al. | 439/179 |
| 3,873,437 | 3/1975 | Pulver | 204/254 |
| 3,878,082 | 4/1975 | Gokhale | 204/226 |
| 3,883,415 | 5/1975 | Shibata et al. | 204/258 |
| 3,960,697 | 6/1976 | Kircher et al. | 204/252 |
| 4,211,269 | 7/1980 | McCutchen et al. | 204/252 |

FOREIGN PATENT DOCUMENTS

| | | |
|---|---|---|
| 0466156 | 1/1992 | European Pat. Off. . |
| 0466266 | 1/1992 | European Pat. Off. . |

OTHER PUBLICATIONS

"Cerro Alloy Physical Data·Applications", brochure of Cerro Metal Products, division of Cerro Corporation, Bellefonte, Pa.

*Primary Examiner*—Donald R. Valentine
*Attorney, Agent, or Firm*—David P. Gordon

[57] ABSTRACT

An external electrical metal conductor strap mounted a spaced distance from the external steel wall of an electrolytic cell where the steel wall is internally joined to the cathodes of the cell with the interspace between the external metal conductor strap and the external steel wall filled with an electrical conductor filler metal so that the external metal conductor strap and the external steel wall of the cell is in continuous electrical contact across the entire surface area interface between the external metal conductor strap and the external steel wall of the electrolytic cell. The filler metal may be a metal alloy that melts and becomes liquid at the normal operating temperature of the cell, or the filler metal may be chosen so that it remains solid at the normal operating temperature of the cell. Alternatively, the filler metal may be an alloy which does not have a precise melting temperature, but rather a melting range through which the alloy first softens, then forms a semi-liquid "slush," and finally becomes a liquid as the temperature is increased.

19 Claims, 4 Drawing Sheets

METHOD AND DEVICE FOR ELECTRICALLY COUPLING A CONDUCTOR TO THE METAL SURFACE OF AN ELECTROLYTIC CELL WALL

FIELD OF THE INVENTION

The invention relates to a diaphragm or membrane or diaphragm-less electrolytic cell for the production of chemicals such as chlorine by the conversion of brine to caustic soda. More particularly, the invention relates to the connection of an external conductor strap to the external surface of the steel wall of the cell.

BACKGROUND OF THE INVENTION

Electrolytic cells for the production of chemicals such as chlorine and caustic soda from aqueous solutions of NaCl generally include a carbon steel cell within which anodes and cathodes are arranged and surrounded by electrolyte. Normally several anodes or a networked grid-like anode is placed within the cell from the bottom and the cathode walls of the cell are connected by a similar grid-like network of fingers so that anodes and cathodes are relatively evenly and closely spaced throughout the electrolyte. Current is supplied to the cathodes via a conductor strap (usually copper) attached to the exterior of the steel cell walls. Current flows from the cathodes through the electrolyte to the anodes and is carried from the anodes by a conductor which insulatingly passes through the bottom of the cell.

Conventional methods of fastening the copper conductor strap to the cathode's steel outer wall include fillet welding, brazing, or silver soldering. Unfortunately, the copper-steel bond is difficult to create and maintain and at best there remain air gaps between the copper strap and the steel cell wall. At worst, fine cracks, fissures, or separations occur in the steel wall of the cell or in the solder joint between the copper and steel. A crack, fissure, or separation allows a small amount of electrolyte to invade the crack, fissure, or separation. The invading corrosive electrolyte may be brine or any other corrosive fluid which spills onto or collects on the exterior surface of the cell. The corrosive liquid begins to attack the cell wall at the small crack, fissure, or separation. As the corrosive attack progresses, the crack, fissure, or separation becomes larger and results in the invasion of progressively more and more corrosive electrolyte. The end result is an ever compounding corrosive attack.

Eventually, large quantities of iron oxide and other contaminants are generated between the copper conductor strap and the cell's steel outer wall. The buildup of rust and other contaminants causes the forcing of the copper conductor strap away from the cell's outer wall. The force of escaping electrolyte actually breaks the welded or brazed or soldered bond between the outer wall and the copper conductor strap. At that point, a very large crack or fissure or separation traps corrosive fluid between the copper conductive strap and the cell's outer steel wall. If this contagion of corrosive attack is unchecked, it will continue until the copper strap is completely separated from the cell wall and the cell wall begins to leak its electrolyte at a rate which renders the cell functionally inoperative.

In practice, cells are removed from a productive cell line for repair prior to such extensive damage. However, the cells are usually allowed to function until the corrosive attack has pushed the copper conductor strap away from the steel outer wall in several places. During the progression of this corrosive attack, the electrolytic cell becomes progressively less efficient as the cracks, fissures, or separations between the copper conductor strap and the cathode's steel outer wall grows larger. The resultant loss in efficiency is caused by several factors, primarily the loss of continuous and uniform electrical conductivity between the copper conductive strap and the cathode's outer cell wall. Under these circumstances, parts of the damaged cathodes carry more electrical current than others. This means that part of the cell is working less efficiently than others. Electrical energy is lost, and the cell produces less product per kilowatt hour as a result.

There have been improvements in the design of electrolytic cells, but most of these improvements relate to the design and placement of the anode rather than improvements to the cathode. For example, U.S. Pat. No. 3,591,483 to Loftfield et al (the complete disclosure of which is incorporated herein by reference) discloses Diaphragm-Type Electrolytic Cells; Use of Dimensionally Stable Anodes" where the cell is provided with a metal base serving as a rigid support and conductor for anodes and which supports the cell itself but is insulated from the cell by a sheet of non-conductive material which also provides an hydraulic seal to prevent leakage of electrolyte through the bottom of the cell.

U.S. Pat. No. 3,873,437 to Pulver (the complete disclosure of which is incorporated herein by reference) discloses an "Electrode Assembly for Multipolar Electrolytic Cells" where an anode carried by a lateral surface of a compartment wall is movable in a direction towards an opposed cathode surface to maintain a narrow gap between the electrodes. A cathode carried by the opposed lateral surface of the same compartment wall is optionally provided with means for moving it in a direction towards the opposed anode surface.

U.S. Pat. No. 3,878,082 to Gokhale (the complete disclosure of which is incorporated herein by reference) discloses a "Diaphragm Cell Including Means for Retaining a Preformed Sheet Diaphragm Against a Cathode" where a preformed sheet material is used as a diaphragm through the use of elasto-polymeric retainers.

U.S. Pat. No. 3,883,415 to Kokubu et al (the complete disclosure of which is incorporated herein by reference) discloses a "Multiple Vertical Diaphragm Type Electrolytic Cell for Producing Caustic Soda" where a large number of unit cells are installed compactly in a cathode tank in electrically parallel connection, each cell having two anode plates interwelded by at least two conductive supporting rods which in turn are connected to outer bus bars. An iron mesh cathode frame lined with an asbestos diaphragm surrounds the anode plates. A corrosion resistant cap is mounted on the iron mesh cathode and a bottom dish is inserted thereinto. The upper part of the anode plates are secured by insulated set screws.

U.S. Pat. No. 3,960,697 to Engler et al (the complete disclosure of which is incorporated herein by reference) discloses a "Diaphragm Cell Having Uniform and Minimum Spacing Between Anodes and Cathodes" where a continuous net is provided between the anodes and the diaphragm to permit minimum and uniform anode-cathode spacing while preventing the diaphragm from adhering to the surface of the anodes.

U.S. Pat. No. 4,211,629 to Bess et al (the complete disclosure of which is incorporated herein by reference) discloses an "Anode and Base Assembly for Electrolytic Cells" where downwardly facing annular portions of the anodes are welded to a perforated metal cell base cover which seals electrolyte in the cell from the cell base eliminating corrosion in the cell base and anode risers.

These improvements, while worthy in their own right, do not address the problem discussed herein, namely, the connection of a conductor strap to the exterior wall of the cell.

In connection with the present invention, it is also noted that bismuth alloys are known to have very low-melting temperatures and low physical strength and have been used as low temperature melting solders for safety devices like sprinkler links, plugs in compressed gas tanks and in fire alarm devices. Bismuth is a heavy, coarse crystalline metal which expands when it solidifies. Water and antimony also expand on freezing, but bismuth expands much more than the former, namely 3.3% of its volume. When bismuth is alloyed with other metals, such as lead, tin, cadmium and indium, this expansion is modified according to the relative percentages of bismuth and other components present. As a general rule bismuth alloys of approximately 50 per cent bismuth exhibit little change of volume during solidification. Alloys containing more than this tend to expand during solidification and those containing less tend to shrink during solidification. After solidification, alloys containing both bismuth and lead in optimum proportions grow in the solid state many hours afterwards. Bismuth alloys that do not contain lead expand during solidification with negligible shrinkage while cooling to room temperature.

SUMMARY OF THE INVENTION

It is therefore an object of the invention to provide a means for attaching a conductor strap to the exterior steel cathode wall of an electrolytic cell so that greater efficiency resulting in power savings is produced due to increased electrical and thermal conductivity between the strap and the cell wall.

It is also an object of the invention to provide a means for attaching a conductor strap to the external wall of an electrolytic cell so that the conductor strap and the steel wall will be in continuous electrical contact across the entire surface area interface between the external metal conductor strap and the external steel wall of the electrolytic cell.

It is another object of the invention to provide protection from oxidation and corrosion of both the conductor strap and the cell wall beneath the conductor strap.

It is a further object of the invention to provide a method for coupling a conductor to the cathode wall of an electrolytic cell which provides functional advantages at reduced cost.

It is still another object of the invention to provide a low pressure seal of small leaks which may arise in the cell wall under the conductor strap.

It is thus an object of the invention to provide for reduced and simplified cell repairs and maintenance.

In accord with these objects which will be discussed in detail below, the invention provides an external metal conductor strap mounted a spaced distance from the external steel wall of an electrolytic cell where the steel wall is internally joined to the cathodes of the cell and the interspace between the external metal conductor strap and the external steel wall is filled with an electrical conductor filler metal alloy. The filler metal may be an alloy that melts and becomes liquid at the normal operating temperature of the cell, or may be chosen so that it remains solid at the normal operating temperature of the cell. Alternatively, the filler metal may be an alloy which does not have a precise melting temperature, but rather a melting range through which the alloy first softens, then forms a semi-liquid "slush," and finally becomes a liquid as the temperature is increased. In the case of an alloy which remains solid during operation of the cell, it may be chosen from a group of alloys which expand when solidified so that the filler metal alloy can be heated and poured into the interspace between the conductor strap and the cell wall wherein it is left to cool and expand forming a tight mechanical bond.

Preferred aspects of the invention include: a copper conductor strap with edges bent inward and welded, brazed or otherwise fastened to the steel cell wall to create a pocket within which filler metal is placed. In one embodiment, filler metal is introduced into the pocket in molten form through a threaded filler plug. In another embodiment, a top portion of the pocket formed by the copper strap is left open and filler metal is dropped, placed or poured into the opening. In embodiments where filler metal becomes molten, one or more drain plugs are provided to allow removal of the filler metal from the interspace between the conductor strap and the cell wall.

Additional objects and advantages of the invention will become apparent to those skilled in the art upon reference to the detailed description taken in conjunction with the provided figures.

DETAILED DESCRIPTION

Figure 1:
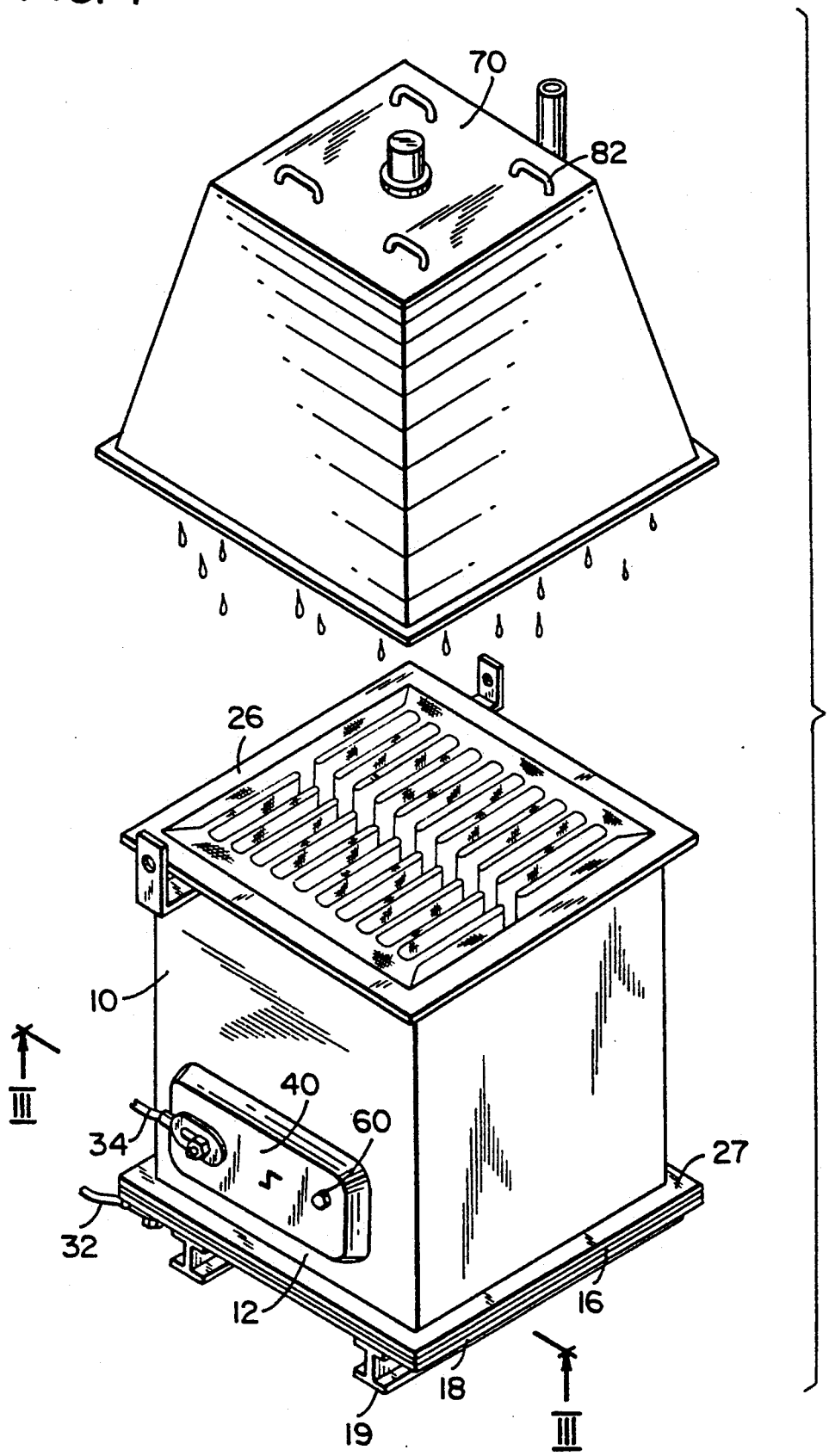
FIG. 1 is a perspective view of the entire electrolytic cell including cover.

Referring now to FIG. 1, an electrolytic cell 10 can be seen having walls 12 with an upper lip 26 and a lower lip 27. Lower lip 27 is mounted on a base 18 which carries anodes (not shown) and is insulated from the base 18 by an insulating layer 16. Base 18 is supported by feet 19 and is coupled to an electrical conductor 32 for coupling the anodes (not shown) to a power source (also not shown). A removable cover 70 with crane handles 82 seals the upper lip 26 during operation. Those skilled in the art will appreciate that this is the basic known configuration of an electrolytic cell but for the placement and electrical coupling of the cathodes.

Figure 2:
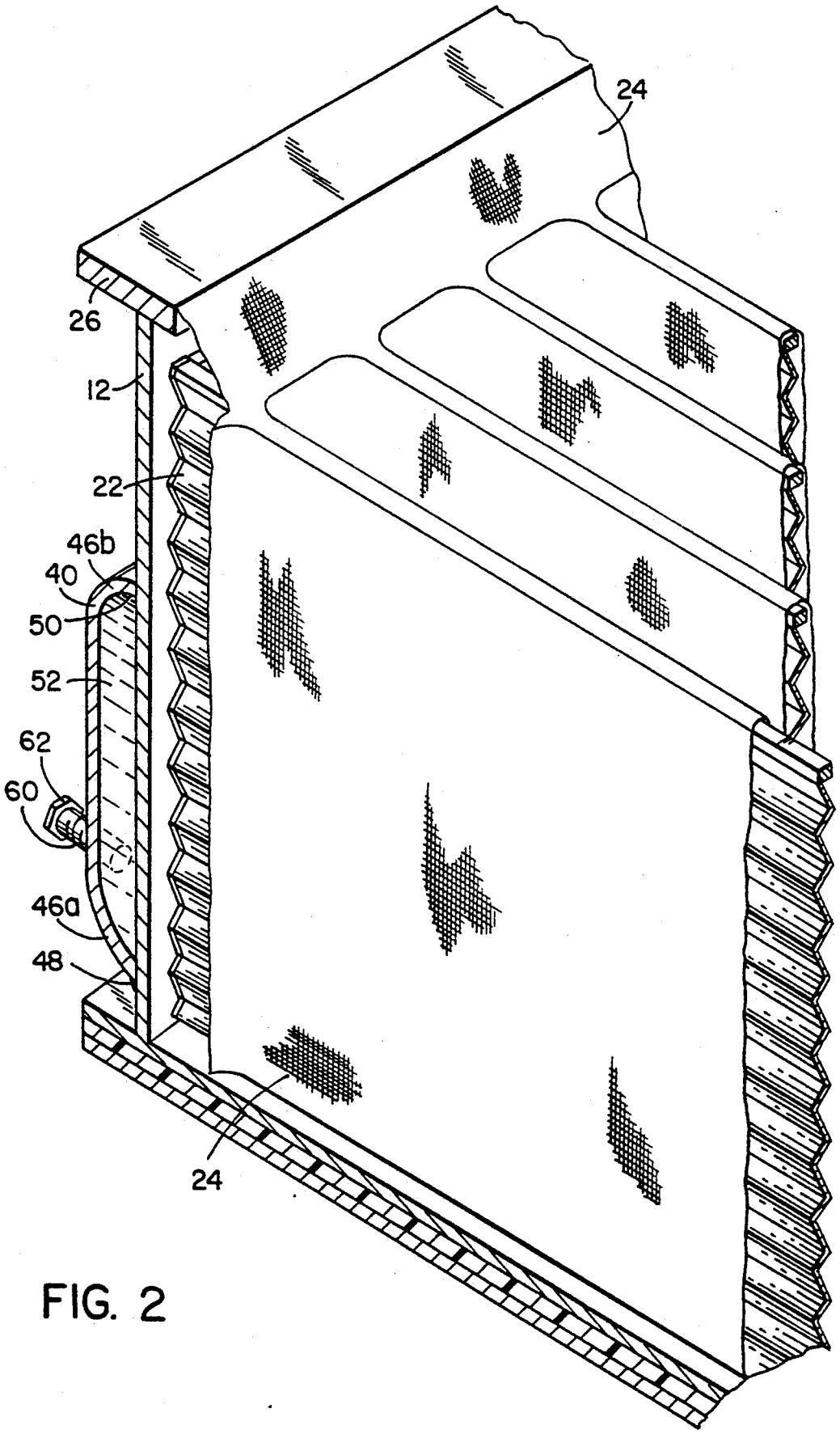
FIG. 2 is a perspective view, partially in cross section of a portion of an electrolytic cell.

Referring now to FIGS. 1 and 2, cathodes 22 are electrically coupled to cell wall 12 and covered with a membrane or diaphragm 24 as is known in the art. Coupling of the cathodes 22 with a power source is made through cell walls 12 as discussed above in the background of the invention. In accord with the present invention, however, this coupling is made by a conductor strap 40 which is mounted spaced apart from the steel cell wall 12 in one of several special ways to create a pocket between the strap and the wall wherein a metal filler is placed.

Figure 3:
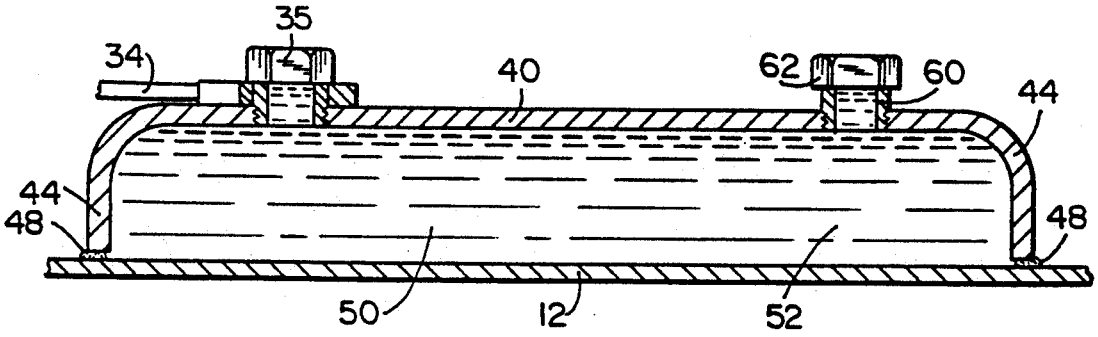
FIG. 3 is a cross sectional view along the line III—III of FIG. 1.

Turning now to FIGS. 1, 2 and 3, it can be seen that in one embodiment of the invention conductor strap 40 is mounted a spaced distance from the cell wall 12 with end edges 44 of the strap and bottom edge 46*a* and top edge 46*b* of the strap bent inward and welded, brazed or otherwise fastened around its perimeter at 48 to the steel cell wall 12 so as to bound a chamber or pocket 50 between the steel cell wall 12 and the strap 40. Strap 40 is coupled to conductor 34 by means of a threaded bolt 35 or other means known in the art. Conductor 34 is then coupled with a power source (not shown) to supply cathodes 22. According to this embodiment of the invention, pocket 50 is sealed by edges 44, 46*a* and 46*b* of strap 40 at welds 48. Therefore, at least one hollow threaded filler plug 60 having a cap 62 (or similar closable opening) is provided on strap 40 for access to the interior of pocket 50. In accord with one embodiment of the invention, pocket 50 is filled with metal filler 52 which enters pocket 50 in a molten state through filler plug 60. Preferably, two or more plugs 60 are provided, one located near the top of strap 40 as shown in FIG. 1 and another located near the bottom of strap 40 as shown in FIG. 2 so that pocket 50 can be partially or completely filled and drained when necessary.

The selection of metal used as filler 52 is based on particulars such as price and availability, but also on electrical and thermal conductivity, coefficient of expansion, melting point, melting range, operating temperature of the cell, ambient temperature of the cell environment, desired electrical current density of the cell, concentration of brine stock and desired quality of the end products, among other considerations. Some suitable metals include, but are not limited to alloys containing metals selected from the group bismuth, lead, tin, cadmium, indium, silver, and copper.

As mentioned hereinabove, filler metal 52 may be an alloy which is liquid at the operating temperature of the cell. By selecting such an alloy to fill the interspace or pocket 50 between conductor strap 40 and cell wall 12, it can be assured that the entire surface area covered by the filler metal is in continuous wetted contact and that the electrical contact between the strap 40 and the cell wall 12 will be continuous and uniform. Considering the density and surface tension of liquid filler metal, it can also be assured that little or no electrolyte will be permitted to leak through any small crack or defect in wall 12 and penetrate the interspace or pocket 50. Thus, the conductor strap 40 and cell wall 12 will not trap electrolyte in the interspace or pocket 50 and the contagion of compounding corrosive attack which eventually destroys most electrolytic cells of similar design will be prevented from its initial stage. Moreover, because of the improved electrical conductivity of the cathode, the entire electrolytic cell can be operated more efficiently over longer periods of time.

Figure 5:
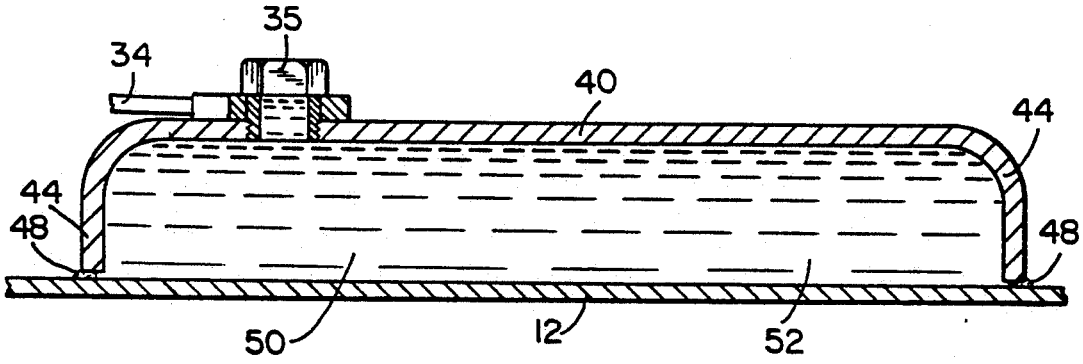
FIG. 5 is a cross sectional view along the line V—V of FIG. 4.
Figure 4:
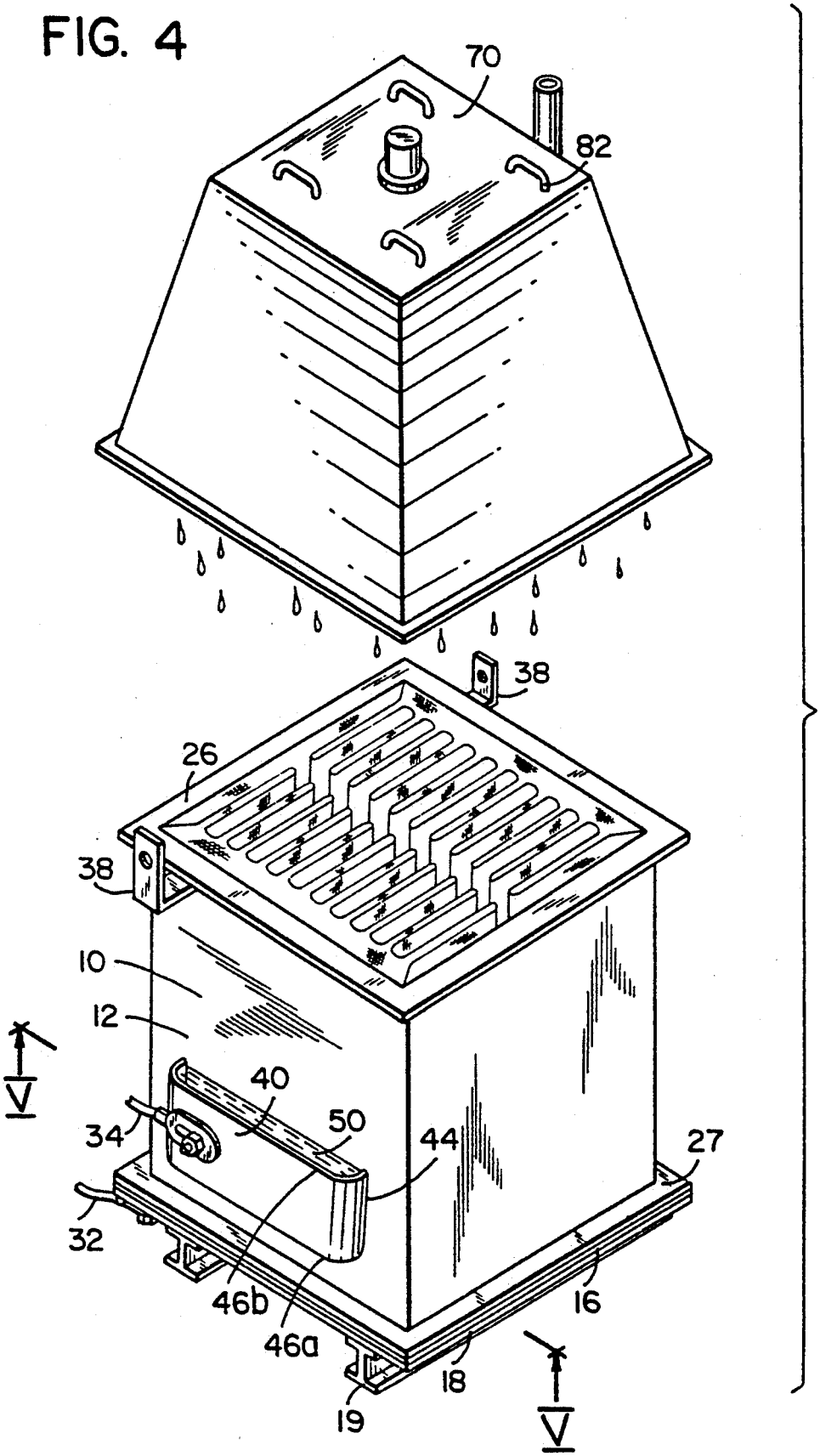
FIG. 4 is a view similar to FIG. 1, but showing another embodiment of the invention.

Referring now to FIGS. 4 and 5, another embodiment of the invention can be seen. Here the conductor strap 40 is mounted spaced apart from wall 12 with side edges 44 and bottom edge 46*a* bent inward and welded, brazed or otherwise fastened at 48 to the steel cell wall 12 so as to bound a pocket 50 between the steel cell wall 12 and the strap 40. In this embodiment, top edge 46*b* of strap 40 is kept spaced apart from wall 12 leaving an opening at the top of pocket 50. In this embodiment, metal filler 52 can be poured directly into the top of pocket 50 if molten or placed, dropped or otherwise inserted into pocket 50 if metal filler 52 is solid. In the case of molten filler, a drain plug such as plug 60 with cap 62 shown in FIGS. 1–3 can be added to the strap 40.

There have been described and illustrated herein several embodiments of a conductor strap for an electrolytic cell and methods of electrically coupling the conductor strap to the cell wall. While the invention was described primarily in terms of the apparatus invention, it will be appreciated that the method invention is related directly thereto and comprises steps such as forming a pocket defining conductive plate, attaching the plate to the steel wall of the cell, filling the pocket interspace between the plate and the wall with filler metal, etc. While particular embodiments of the invention have been described, it is not intended that the invention be limited thereto, as it is intended that the invention be as broad in scope as the art will allow and that the specification be read likewise. Thus, while particular metals such as copper have been disclosed as constituting the strap, it will be appreciated that other constituent metals could be utilized. Also, while particular alloys for the metal filler have been discussed, it will be recognized that other types of alloys could be used with similar results obtained. Moreover, while particular configurations have been disclosed in reference to the welding or otherwise attaching of the strap to the cell wall, it will be appreciated that other configurations involving a mechanical connection of the strap to the cell wall could be used as well. In addition, while drain and filler plugs having threads and caps have been disclosed, it will be appreciated that other similar devices for filling and/or draining the pocket between the strap and the cell wall could be used. Furthermore, while the electrolytic cell itself has been disclosed as having a certain number of walls and electrodes, it will be understood that different configurations of the electrolytic cell can be used with the invention disclosed herein. Lastly, while an electrolytic cell for the production of chlorine and caustic soda from saline electrolyte has bee discussed, it will be understood that the invention can be used with electrolytic cells for the production, concentration, or purification of other chemicals as well and even for attaching conductors to metal surfaces of devices other than electrolytic cells.

It will therefore be appreciated by those skilled in the art that yet other modifications could be made to the provided invention without deviating from its spirit and scope as so claimed.

I claim:

1. A method for electrically coupling a conductor to a cathode metal surface, comprising:

a) forming a cathode strap conductive plate in a manner such that when the cathode strap conductive plate is attached to the cathode metal surface a pocket interspace is formed between the cathode strap conductive plate and the cathode metal surface;

b) attaching the cathode strap conductive plate to the cathode metal surface to form the pocket interspace;

c) substantially filling the pocket interspace with a liquid or amorphous conductive metal; and d) attaching the conductor to the cathode strap conductive plate.

2. A method according to claim 1 further comprising:

sealing the pocket interspace between the cathode metal surface and the cathode strap conductive plate.

3. A method according to claim 1 wherein:

the conductive metal is molten.

4. A method according to claim 1 further comprising:

forming a closable aperture in the cathode strap conductive plate.

5. A device for electrically coupling a conductor to a cathode metal surface, comprising:

a) a cathode strap conductive metal plate;

b) first attachment means for attaching said cathode strap conductive metal plate to the cathode metal surface, wherein said cathode strap conductive metal plate is shaped to form a pocket interspace between said cathode strap conductive metal plate and the cathode metal surface when said cathode strap conductive metal plate is attached to the cathode metal surface;

c) filler metal substantially filling said interspace; and d) second attachment means for attaching said conductor to said cathode strap conductive metal plate.

6. A device according to claim 5 wherein:

said filler metal is an alloy containing a metal chosen from the group consisting of bismuth, lead, tin, cadmium, indium, silver, and copper.

7. A device according to claim 5, wherein:

said cathode strap conductive plate is provided with an opening, and said device further comprises removable closure means for opening and closing said opening.

8. A device according to claim 7, wherein:

said interspace is sealed by said first attachment means.

9. A device according to claim 5, wherein:

said filler material is molten when the cathode metal surface is at its operating temperature.

10. A device according to claim 5, wherein:

said filler material is solid when the cathode metal surface is at its operating temperature.

11. A device according to claim 5, wherein:

said filler material is amorphous when the cathode metal surface is at its operating temperature.

12. A device according to claim 5, wherein:

said cathode metal surface is made from steel, and said cathode strap conductive plate is made from copper.

13. An improved electrolytic cell, comprising:

a) a metal tank having a wall and a bottom for containing an electrolyte;

b) a first electrode suspended in said tank and electrically insulated from said tank;

c) a second electrode extending from said wall of said tank and electrically connected to said tank;

d) first attachment means for attaching a first conductor to said first electrode;

e) a conductive strap plate;

f) second attachment means for attaching said conductive strap plate to said wall, wherein said conductive strap plate is shaped such that when it is attached to said wall, a pocket interspace is formed between said conductive strap plate and said wall;

g) filler metal substantially filling said pocket interspace;

h) third attachment means for attaching a second conductor to said conductive strap plate.

14. An improved electrolytic cell according to claim 13, wherein:

said conductive strap plate has an aperture extending therethrough.

15. An improved electrolytic cell according to claim 14, further comprising:

removable closure means for opening and closing said aperture.

16. An improved electrolytic cell according to claim 13, wherein:

said filler metal is molten when said cell is operating.

17. An improved electrolytic cell according to claim 13, wherein:

said filler metal is solid when said cell is operating.

18. An improved electrolytic cell according to claim 13, wherein:

said fillter metal is amorphous when said cell is operating.

19. An improved electrolytic cell according to claim 13, wherein:

said wall is made from steel, and said conductive strap plate is made from copper.

* * * * *